US012644065B2

(12) United States Patent
Wattson Gomez

(10) Patent No.: US 12,644,065 B2
(45) Date of Patent: Jun. 2, 2026

(54) BIOFUEL DERIVED FROM GLYCEROL ESTERS AND METHOD FOR OBTAINING SAME

(71) Applicant: UNIVERSIDAD DE COSTA RICA, San Pedro de Montes de Oca-San Jose (CR)

(72) Inventor: Rodolfo Wattson Gomez, San Jose (CR)

( * ) Notice: Subject to any disclaimer, the term of this patent is extended or adjusted under 35 U.S.C. 154(b) by 277 days.

(21) Appl. No.: 18/036,535

(22) PCT Filed: Jul. 2, 2020

(86) PCT No.: PCT/CR2020/000001

§ 371 (c)(1),
(2) Date: Mar. 15, 2024

(87) PCT Pub. No.: WO2022/002287

PCT Pub. Date: Jan. 6, 2022

(65) Prior Publication Data

US 2024/0336858 A1 Oct. 10, 2024

(51) Int. Cl.
*C10L 1/12* (2006.01)
*C10L 1/32* (2006.01)

(52) U.S. Cl.
CPC ..... *C10L 1/1233* (2013.01); *C10L 1/328* (2013.01); *C10L 2200/0254* (2013.01); *C10L 2250/08* (2013.01); *C10L 2290/06* (2013.01); *C10L 2290/08* (2013.01); *C10L 2290/542* (2013.01); *C10L 2290/543* (2013.01); *C10L 2290/547* (2013.01)

(58) Field of Classification Search
CPC ..... C10L 1/1233; C10L 1/328; C10L 2200/0254; C10L 2250/08; C10L 2290/06; C10L 2290/08; C10L 2290/542; C10L 2290/543; C10L 2290/547; C10L 1/10; C10L 1/1881; C10L 10/02
See application file for complete search history.

(56) References Cited

FOREIGN PATENT DOCUMENTS

KR 20160022585 A * 3/2016

* cited by examiner

*Primary Examiner* — Latosha Hines
(74) *Attorney, Agent, or Firm* — Jerold I. Schneider; Allen F. Bennett

(57) ABSTRACT

The present invention relates to a combustion additive comprising iron oxide nanoparticles; a fuel based on natural plant and animal fats and oils; and a method for producing the same. The production method allows up to 100% of the raw material, both virgin and waste fats and oils, to be used. The combustion additive and the fuel are useful in the combustion process; for example, in diesel-type alternative combustion engines.

17 Claims, 2 Drawing Sheets

BIOFUEL DERIVED FROM GLYCEROL ESTERS AND METHOD FOR OBTAINING SAME

TECHNICAL FIELD OF THE INVENTION

The present invention relates to the field of fuels and combustion additives, specifically fuels essentially based on carbon, hydrogen, and oxygen; mixtures with metallic salts. Particularly the use of crude and second-use fats and oils.

BACKGROUND OF THE INVENTION

The present invention aims to provide an iron hydroxide nanoparticle combustion additive that reduces the presence of deposits generated by incomplete combustion in fuels; and a fuel, from fats or oils, with a suitable viscosity for use in combustion engines or similar processes; as well as its method of obtaining it.

Said proposed method, in an ideal configuration, allows to take advantage of 100% of the original raw material, generating a fuel and a combustion additive. In addition, the method allows the use of both crude and reusable fats and/or oils and aims to take advantage of the usual free fatty acid contaminants in natural fats, to generate an additive of iron hydroxide nanoparticles.

In the field of fuels, fats and oils are considered by themselves as fuels and are a source of energy that can be generated from renewable raw materials. However, the use of greases, oils of different natures and chains must be treated so that they have adequate properties to be used as fuels in conventional combustion engines. Among the existing solutions is the production of biodiesel, for example* the United States patent document US 2006/0504828, proposes a method for the production of biodiesel from raw materials with a high content of free fatty acids. Application WO2015/162307 proposes a biodiesel production method from recycled oils. However, the existing methods for the generation of biodiesel always have glycerol or glycerin as residue in large quantities, which is why it is considered an environmental and economic problem and has become such a big problem that the current industry does not know what to do with so much of this by-product. In addition to this, the carbon footprint of biodiesel as a fuel continues to be high.

On the other hand, the Spanish patent document ES 2002/00001003, and the Brazilian patent application BR PI 1004396 A, have tried to address the problem of large amounts of glycerol as a by-product of the biodiesel process. They take glycerol and transform it into an additive that is reincorporated into the same fuel, however, what this additive contributes is an improvement in the lubrication conditions of the fuel, but it does not address the problem of the carbon footprint of biodiesel as a fuel.

Other inventions, such as patent ES 2006/00001918, seek to propose renewable source fuels from monoesters of glycerol fatty acids. However, they continue to produce glycerol as waste.

Other fuel alternatives are the generation of modified fats or oils, an example is the Spanish patent ES2433072 where the cross-esterification modification method is shown. However, these methods show that modified greases or oils are a viable fuel source if it is possible to reach appropriate viscosities, however, they do not attack the problem of high carbon footprint, they only refer to improvement in lubrication issues and there is not much published data on utilization.

Regarding the reduction of the carbon footprint, the Korean patent application KR 2004/0070356 (A) and the U.S. Pat. Nos. 4,843,980 and 8,906,120 demonstrate the introduction of iron salts or iron oxides as combustion improvers, and in the French patent application FR2632966, iron hydroxides. However, they are isolated processes and do not constitute the use of renewable sources, nor the use of the usual free fatty acid contaminants in natural fats, to generate a combustion additive.

Consequently, it is necessary to generate combustion products from renewable sources, which in turn allows the reuse of second-use oils and fats, which has a low carbon footprint, and in turn is obtained through a production method that does not generate amounts of unwanted by-products, and make the most of the raw material.

DETAILED DESCRIPTION OF THE INVENTION

Figure 1:
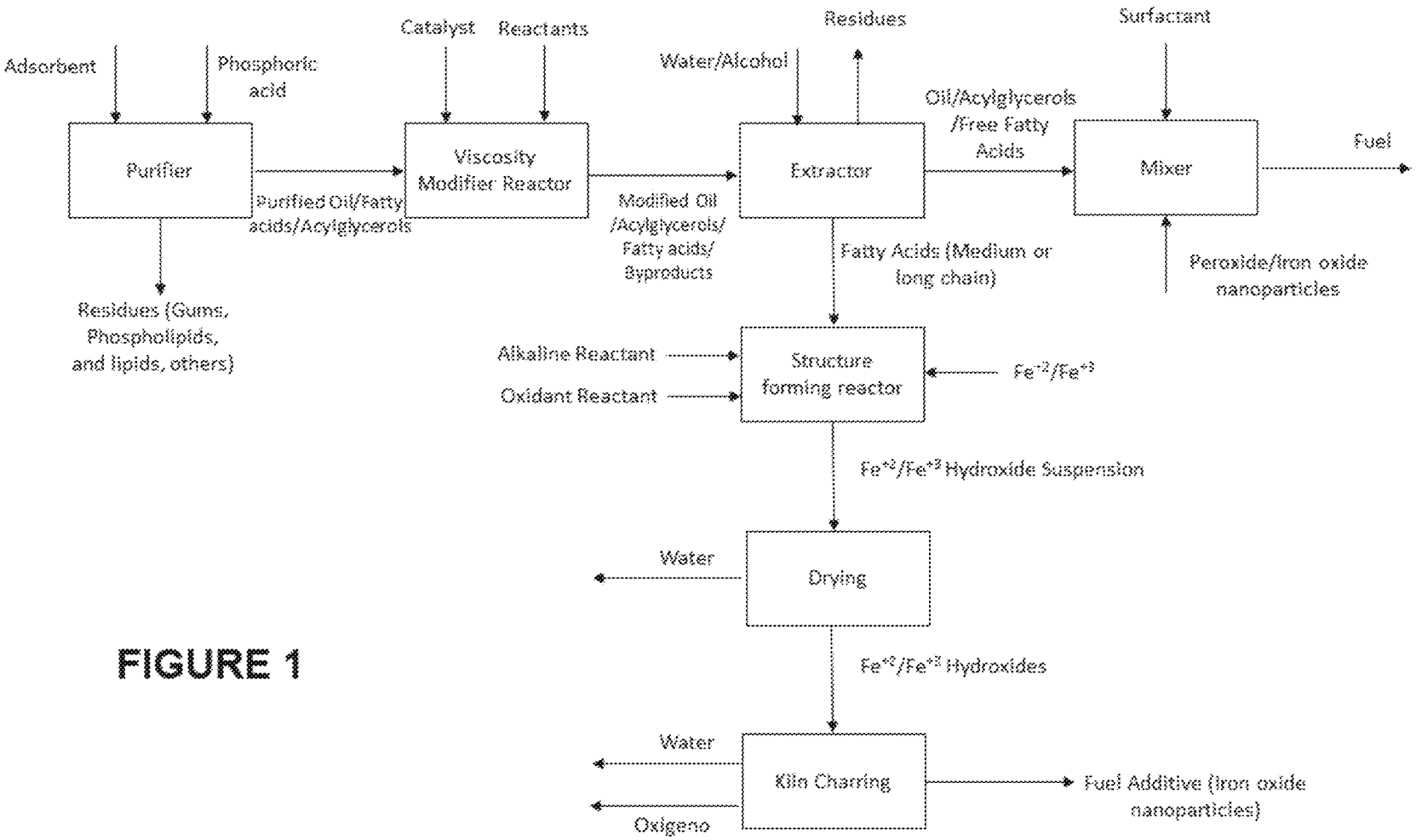
FIG. 1 is a block diagram illustrating the method of the present invention.
Figure 2:
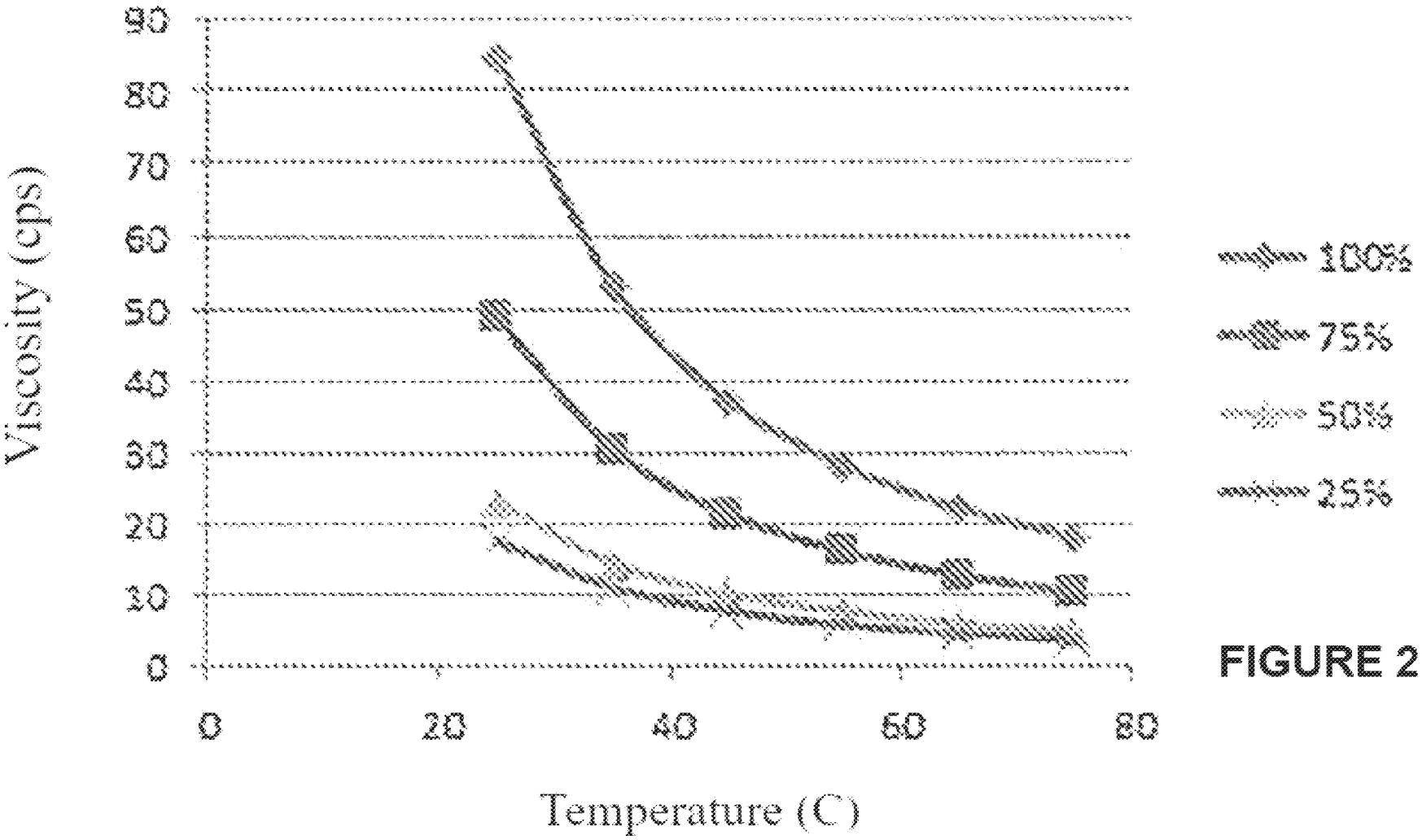
FIG. 2 shows the viscosity reduction (CPS) vs. temperature (C) for the equivalent length of an average triglyceride molecule resulting from modifying a grease molecule at different average chain reduction percentages (C1+C2+C3)/3 and calculating the modification required to obtain a given viscosity.

The present invention allows, in an ideal configuration, to obtain a combustion additive and a fuel from various natural raw materials of crude or reused fats or oils, among which we can mention, without limiting the present invention: vegetable oils such as palm oil, soybean oil, coconut oil, sunflower oil, algae oil, and animal waste such as fish. All of them with different purity.

During the method of the present invention, the raw material is subjected to a purification process that consists of the following steps:

1—Acidification with phosphoric acid to precipitate rubber and phospholipids,

2—Adsorption to remove polar lipids,

3—Filtration at 5-50 μm mesh.

The acidification step could be optional when the fats and/or oils are specifically for reuse and are not combined with any type of fat and/or oils that contain rubber and/or phospholipids, In a next stage, the oil free of sediments, particles, phospholipids and rubber (with free fatty acids) or with different degrees of refining is reacted with free fatty acids or activated fatty acids (for example: esters, anhydrides, triacylglycerols, among others), by means of an inter-esterification, transesterification or acidolysis reaction in the presence of a suitable catalyst in order to obtain triacylglycerol, with the appropriate or required viscosity, as the main product and free fatty acids of different chain sizes, acylglycerols and other by-products. It is important to control the viscosity property within the quality parameters of the fuel to be replaced, for example, and without limiting the present invention, for the replacement of diesel the normal thing is a final range between 1-100 cps, in a more suitable configuration between 1-10 cps and a variable acidity of 0-50%. To substitute any fuel, the final product can be characterized by the characterization standard for the fuel to be replaced, for example, diesel, bunker or others, with low sulfur content and be approved according to its parameters.

The mixture obtained from the above reaction is fractionated to obtain a fraction rich in free or activated fatty acids of medium or long chain, from 6 to 20 carbon atoms; a fraction rich in free or activated short-chain fatty acids, y and a fraction rich in triacylglycerols and acylglycerols. This fractionation, in a suitable configuration and without limiting the present invention, can be carried out with water, alcohol or water-alcohol mixtures, and/or vacuum distillation.

In an optional configuration, the fraction rich in short chain fatty acids (2 to 6 carbon atoms) is distilled and can be recycled to the second stage reactor.

The fraction rich in long and medium chain fatty acids (from 8 to 20 carbon atoms) are reacted in an oxygen-free alkaline environment with iron salts in order to produce iron hydroxides of controlled size.

In this process, the Fe2+ and Fe 3+ iron salts are found in a Fe2+/Fe3+ ratio of 0.1-10, and they are reacted with an oxidizing agent, always in an alkaline medium and in the absence of oxygen, where the oxidizing agent is selected from hydrogen peroxide (with a concentration purity of 0-35% m/m), organic peroxides, sodium hypochlorite, calcium hypochlorite or the like. The product obtained is dried at a temperature of −20 to 100° C., until free moisture is eliminated, and then it is calcined at a temperature of between 100 and 500° C. The alkaline agent serves to precipitate the iron salts as mixtures of hydroxides, which when calcined remain as iron hydroxide nanoparticles. This final product is a combustion additive that improves combustion in fuels, reducing their carbon footprint.

On the other hand, for the present invention, the fraction rich in triacylglycerols and the acylglycerols obtained from the inter-esterification, transesterification or acidolysis reaction are emulsified in suitable proportions with hydrogen peroxide, with the additive of iron oxide nanoparticles or a mixture of both obtaining a fuel with suitable physicochemical properties to be used in compression, injection, or combustion engines, or similar processes.

To achieve emulsification with hydrogen peroxide (concentration purity between m/m), iron nanoparticles additive or a mixture of both, pure or mixed surfactants are added, ensuring that the HL8 of the surfactants is from 0 to 20.

For purposes of calculating the amount of hydrogen peroxide, the molar composition of carbon and hydrogen in the mixture is taken as a basis. The molar ratio of the mixture-hydrogen peroxide is from 1000:1 to 1:1, preferably the one that provides a positive balance of $CO_2$ and $H_2O$ in the fuel mixture, taking into account peroxide as a donor of hydroxyl radicals —OH The overall reaction without peroxide would be:

$$Cx\ H\ x+n+(x+(n+x)/4)O2 \rightarrow X\ CO_2+(n+x)/2H_2O$$

With peroxides it would be $$Gx\ H\ x+n+x\ H_2O_2+n/2O_2 \rightarrow XCO_2+(n+3x\}/2\ H_2O$$

If oxygen is added to the mix, the required oxygen balance is changed, lowering it.

In summary, the amount of peroxide ranges from 0.01-10 times the value of X in moles/mol of fuel, preferably in values close to submultiples of (1+((n+1)/4 in the range of 0, 01-0.25 with respect to the oxygen used by the engine.

The addition of hydrogen peroxide not only helps to reduce the production of nitrous oxides, but also allows better oxidation of the fuel, thereby reducing the production of CO, particulate matter and hydrocarbons during combustion.

It is known that the mixture of triacylglycerols and acylglycerols constitute a first biofuel by itself, however, emulsification with peroxide, with the additive or a mixture of both allows obtaining a fuel with low carbon emissions. For this reason, the fuel can be mixed with hydrocarbons, additives or other fuels, an example of application is the case of mixing with diesel, where a final viscosity is obtained that is proportional to the volumetric fraction of the mixture and to the viscosity of each component until reaching a value close to 3 CPS in the case of a triacylglycerol composed of acetyl groups. Therefore, the final viscosity of the fuel mixture ranges between 100 and 1 CPS at room temperature in order to approximate the fuel of interest (for example, diesel).

This same fuel can be mixed with the previously obtained iron nanoparticles additive and the combustion and atomization properties of the mixture are improved.

For different mixtures of fats or oils used as raw material for the claimed method, FIG. 3 shows us the viscosity reduction (CPS) vs. temperature (C) for the equivalent length of an average triglyceride molecule resulting from modifying at different percentages of average chain reduction (C1+C2+C3)/3 a molecule of fat and calculating the modification required to obtain a given viscosity, A; 100% unmodified original triglyceride chains (18C)

B; 75% modified chains to 75% of original value (13.5C)

C: 50% modified strings to 55% of original value (9G)

D: 25% modified chains to 25% of original value (4.5G)

Example of how to Put the Invention into Practice

As an example, and without limiting the present invention, a partial substitution of diesel for the claimed fuel was carried out, resulting in fuel/diesel mixtures up to 20% v/v. All the mixtures obtained meet the quality requirements of ASTM standards or similar standards for diesel fuels, as shown below.

| Essay Method | Test | Result 20% | Result 15% | Result 10% | Result 5% | Specification limits |
|---|---|---|---|---|---|---|
| *ASTM D-4052 | Density at 15° C. | 856.6 | 849.7 | 853.1 | 850.3 | Report |
| **ASTM D-6045 | ASTM Color | 3 | 3 | 3.0 ASTM | 3.0 ASTM | Report |
| **ASTM D-4176 | Visual Inspection | | | | | |
| | Sample temperature | 22.0 | 21.0 | 21.0 | 21.0 | N/A |
| | Appearance | Clear-Bright | Clear-Bright | Clear-Bright | Clear-Bright | Clear-Bright |
| | Free water | Absent | Absent | Absent | Absent | N/A |
| | Particles | Present | Present | Present | Present | N/A |
| ASTM D-2709 | Water volume fraction | 0.025 | 0.025 | 0.025 | 0.025 | Max 0.05% v/v |

-continued

| Essay Method | Test | Result 20% | Result 15% | Result 10% | Result 5% | Specification limits |
|---|---|---|---|---|---|---|
| ASTM D-130 | Copper strip corrosion, 3h a | 1 | 1 | 1 | 1 | Max 2 |
| ASTM D-93 | Flash point | 65.0 | 64.0 | 64.0 | 65.0 | Min 52.0° C. |
| ASTM D-2622 | Mass fraction of sulfur | 5.9 | 10.2 | 6.5 | 10.7 | Max 50 mg/kg |
| ASTM D-976 | Calculated cetane index | 47.8 | 49.6 | 47.9 | 46.4 | Min 45 Units |
| ASTM D-86 | Recovery temperature | | | | | |
| | Inicial point | 169.7 | 160.5 | 163.3 | 168.4 | Report |
| | Fraction Vol 10% | 208.0 | 201.3 | 206.0 | 207.9 | Report |
| | Fraction Vol 50% | 280.1 | 277.9 | 270.7 | 271.7 | Report |
| | Fraction Vol 90% | 320.8 | 339.8 | 334.3 | 343.2 | Max. 360° C. |
| | Final Point | 328.8 | 344.5 | 334.3 | 346.5 | N/A |
| | Volume fraction recovered | 96.9 | 96.2 | 98.2 | 98.0 | N/A |
| | Waste volume fraction | 2.5 | 3.0 | 1.0 | 1.0 | N/A |
| | Volume Fraction Loss | 0.6 | 0.6 | 0.8 | 1.0 | N/A |
| | Observed barometric pressure | 101.0 | 100.6 | 101.0 | 100.5 | N/A |
| ASTM D-6749 | Pour point | −19 | −21 | −14.0 | −18 | Report |
| ASTM D-7683 | Intubation point | −15 | −17 | −12.0 | −13 | Max 10° C. |
| ASTM D-2624 | Electric conductivity | 264 | 194 | 146.9 | 163.2 | Min 25 pSm |
| ASTM D-445 | Kinematic viscosity at 40° C. | 3.89 | 3.8 | 3.54 | 3.34 | 1.90 to 4 mm3/s |
| ASTM D4057 | Sampling manual | | | | | Report |

The invention claimed is:

1. Method for preparing an iron nanoparticle combustion additive and a fuel from fats, oils or a mixture of both, comprising the steps of:

a. purifying crude fats and/or oils to remove rubber, phospholipids, lipids, and particles;

b. reacting with free fatty acids or activated fatty acids, in excess, by interesterification, transesterification or acidolysis, in the presence of a suitable catalyst, of the fats and/or oils purified from the previous stage to obtain triacylglycerol with suitable viscosity, free fatty acids of different chain sizes, acylglycerols and others;

c. fractioning the mixture obtained from stage b to obtain a rich in free or activated medium or long chain fatty acids fraction, from 6 to 20 carbon atoms, a rich in free or activated short chain fatty acids fraction (2 to 6 carbon atoms), and a rich in triacylglycerols and acylglycerols fraction;

d. reacting the rich in medium or long chain fatty acids fraction, in an oxygen-free alkaline environment, with iron salts in the presence of an oxidizing agent;

e. filtering or settling the precipitate obtained from stage d, to obtain a partially moist solid;

f. drying the partially moist solid obtained from step e, to obtain an agglomerated powder of iron hydroxides;

g. calcining the agglomerated powder of iron hydroxides obtained from step £ to obtain an iron nanoparticles additive;

h. emulsifying the rich in triacylglycerols and acylglycerols fraction with hydrogen peroxide or the iron nanoparticles additive obtained from step g. or a mixture of both, in the presence of a surfactant, to obtain a fuel.

2. The method according to claim 1, characterized in that the step a. of purifying of crude fats and/or oils includes the steps of:

a. acidification of crude fats and/or oils with phosphoric acid to precipitate rubber and phospholipids;

b. adsorption to remove polar lipids; and c. filtration with a mesh of 5 to 50 μm.

3. The method according to claim 2, characterized in that the acidification step a. is optional when the fats and/or oils are only for reuse.

4. The method according to claim 1, characterized in that the fractioning step c. is carried out with water, alcohol, or alcohol/water mixture in order to adjust the content of free fatty acids.

5. The method according to claim 1, characterized in that the fractioning step c. is carried out by vacuum distillation.

6. The method of claim 1, characterized in that the rich in free or activated short-chain fatty acids fraction is distilled and recycled to stage b.

7. The method of claim 1, characterized in that in step d, the reaction of the fraction rich in medium or long chain fatty acids is carried out at a pH between 8-14.

8. The method of claim 7, characterized in that the pH is 10.

9. The method of claim 1, characterized in that in step d the reaction is an oxidation reaction that is carried out in a Fe+2/Fe+3 ratio between 0.1 to 10.

10. The method of claim 1, characterized in that in step e. the filtration is done with a mesh size of 1 to 100 μm.

11. The method of claim 10, characterized in that the mesh is μm.

12. The method of claim 1, characterized in that in step £ drying is carried out at a temperature between −20 to 100 C.

13. The method of claim 1, characterized in that in step g. the calcination of the iron hydroxides is carried out between 10° and 500° C. to produce the iron oxide nanoparticles.

14. The method of claim 1, characterized in that in step d. iron salts are chlorides, nitrates, or iron salts.

15. The method of claim 1, characterized in that in step d. the oxidizing agent is selected from hydrogen peroxide, organic peroxides or hypochlorites.

16. The method of claim 1, characterized in that in step h. the surfactant is an emulsifier having an HLB between 0 and 20.

17. The method of claim 1, characterized in that in step h. the surfactant used is lower than 20% v/v.

* * * * *